US011055984B2

(12) United States Patent
Murphy

(10) Patent No.: US 11,055,984 B2
(45) Date of Patent: Jul. 6, 2021

(54) MONITORING A SENSOR OUTPUT TO DETERMINE INTRUSION EVENTS

(71) Applicant: Network Integrity Systems, Inc., Hickory, NC (US)

(72) Inventor: Cary R. Murphy, Hickory, NC (US)

(73) Assignee: Network Integrity Systems, Inc.

( * ) Notice: Subject to any disclaimer, the term of this patent is extended or adjusted under 35 U.S.C. 154(b) by 0 days.

(21) Appl. No.: 16/379,185

(22) Filed: Apr. 9, 2019

(65) Prior Publication Data

US 2019/0311608 A1 Oct. 10, 2019

Related U.S. Application Data

(60) Provisional application No. 62/655,607, filed on Apr. 10, 2018.

(51) Int. Cl.
*G08B 29/18* (2006.01)
*G08B 13/16* (2006.01)

(52) U.S. Cl.
CPC ..... *G08B 29/185* (2013.01); *G08B 13/1654* (2013.01); *G08B 29/183* (2013.01)

(58) Field of Classification Search
CPC ..... G08B 29/185; G08B 29/183; G08B 13/1654; G08B 13/2498; G08B 13/10; H04B 10/00; B60R 25/1004; B60R 25/2054
See application file for complete search history.

(56) References Cited

U.S. PATENT DOCUMENTS 7,725,026 B2 * 5/2010 Patel ..... A61K 8/9794 398/16
2006/0244591 A1 * 11/2006 Takasuka ..... B60R 25/1004 340/541
2007/0008123 A1 * 1/2007 Swanson ..... G08B 13/186 340/541
2007/0077064 A1 * 4/2007 Murphy ..... H04B 10/00 398/13
2007/0216529 A1 * 9/2007 Hobden ..... G08B 29/185 340/552
2007/0285233 A1 * 12/2007 Inomata ..... G08B 13/2497 340/552
2008/0100493 A1 * 5/2008 Akita ..... G01S 13/931 342/20

(Continued)

*Primary Examiner* — Hoi C Lau
(74) *Attorney, Agent, or Firm* — Adrian D. Battison; Ade & Company Inc.; Ryan W. Dupuis

(57) ABSTRACT

A method of detecting intrusion events including at least two different event types which have different characteristics of frequency and time comprises providing a sensor responsive changes in a medium generated by a potential intrusion event with the sensor generating an output signal indicative of the changes in the medium, analyzing the signal to determine changes in amplitude so as to detect the change in amplitude of the detection signal as a function of time, and performing at least one of: (i) in the frequency domain, carrying out a frequency analysis of the signal from the sensor and dividing the frequency analysis into separate sections which are selected so as to correspond to the characteristic frequencies for each event type, or (ii) the algorithm requiring the presence or absence of a time domain step function.

4 Claims, 3 Drawing Sheets

(56) References Cited

U.S. PATENT DOCUMENTS

| | | | | |
|---|---|---|---|---|
| 2009/0009381 | A1* | 1/2009 | Inaba | G01S 13/536 342/109 |
| 2009/0161915 | A1* | 6/2009 | Chen | A61B 5/1117 382/107 |
| 2010/0027378 | A1* | 2/2010 | Sabatier | G08B 13/1672 367/136 |
| 2011/0098932 | A1* | 4/2011 | Lapidot | G01V 1/001 702/14 |
| 2011/0169638 | A1* | 7/2011 | Krumhansl | G01V 1/001 340/566 |
| 2012/0217351 | A1* | 8/2012 | Chadwick | B61L 25/025 246/169 R |
| 2013/0030769 | A1* | 1/2013 | Asanuma | G01S 7/354 702/189 |
| 2017/0152697 | A1* | 6/2017 | Dehelean | G07C 9/00309 |
| 2019/0311608 | A1* | 10/2019 | Murphy | G08B 13/1654 |
| 2019/0385057 | A1* | 12/2019 | Litichever | H04L 63/1416 |

* cited by examiner

MONITORING A SENSOR OUTPUT TO DETERMINE INTRUSION EVENTS

This application claims the benefit under 35 U.S.C. 119(e) of U.S. Provisional application Ser. No. 62/655,607 filed Apr. 10, 2018 which is incorporated by reference herein.

This application relates to an apparatus or method for monitoring sensor output for evidence of intrusion events for the purpose of separating different intrusion events having different characteristics. This is particularly but not exclusively applicable to monitoring a containment barrier for intrusion. Such a barrier may be a fence but also can include barriers enclosing data networks, wells, railroads, infrastructure and any other structure which requires to be maintained secure from intrusion by an unauthorized person. The containment barrier may be around a perimeter so as to contain the structure or may be a simple short barrier portion at a specific location to provide prevention against intrusion at that location.

The sensor detects an effect on a medium such as current in a wire, optical signals in a fiber, air movement generated by sounds and many other examples.

BACKGROUND OF THE INVENTION

In an environment of increased security, including protection of assets such as data and facilities, a need exists to monitor a fence line or barrier against intrusion. In secure installations, such as military bases, prisons, data centers, and other locations where an unauthorized intruder may pose a threat, there is a need to monitor the fence. Events to be detected include an intruder climbing the fence or cutting an opening in the fence fabric. It is a requirement of a holistic security system to detect this breach and report it to the appropriate personnel for appropriate action.

It is known that the challenges to a fence monitoring system include the following:

high sensitivity to true positive alarms;

suppression of false positive alarms; and discrimination of the type of event—specifically, the ability to differentiate between the following:

a true climb;

the fence fabric being cut, such as with snips; and wind disturbing the fence fabric in the absence of a nefarious attack.

The state of the art is divided into two sections: a physical detection mechanism which is provided by a sensor responsive to the effect on the medium concerned; and detection of actual events and separating them from false alarms using the suppression algorithms set out herein.

The physical monitoring and detection mechanisms can include two most common methods of electrical and optical. Electrical monitoring and detection typically requires stringing and fastening an electrical cable along the length of the fence or other barrier. This cable is typically optimized for sensitivity to the piezo electric affect, and is monitored by electronics that are intended to detect motion, vibration, and deflection of the sensor wire or cable caused by piezoelectric currents in the cable.

Optical monitoring and detection typically requires stringing and fastening an optical cable, that is, a cable containing fiber optic fibers, along the length of the fence. This cable is typically optimized for sensitivity to affecting one of the following optical parameters:

state of polarization as measured by equipment such as a Stokes Polarimeter;

distribution of optical modes within the fiber (modal metric sensing);

changes in fiber length due to compression and expansion, as measured by bulk interferometry (including interferometers such as Sagnac or Michaelson);

or phase sensitive optical time domain interferometry ($^{SM}$-OTDR).

SUMMARY OF THE INVENTION

According to an aspect of the invention there is provided a method of detecting intrusion events including at least two different event types which have different characteristics of frequency and time, the method comprising:

providing a sensor responsive changes in a medium generated by a potential intrusion event with the sensor generating an output signal indicative of the changes in the medium;

analyzing the signal to determine changes in amplitude so as to detect the change in amplitude of the detection signal as a function of time;

in the frequency domain carrying out a frequency analysis of the signal from the sensor;

and dividing the frequency analysis into separate sections which are selected so as to correspond to the characteristic frequencies for each event type.

Preferably the algorithm in the frequency domain provides a combination of events in a multi-dimensional matrix that analyzes at least one of relative amplitude of each frequency, the duration of each detected event, the repetition rate of said event, the period over which this event occurs, and the presence or absence of a time domain step function.

Preferably the selection of the characteristic frequencies allows the detection and suppression of false alarms using the algorithms for the signals obtained by the above techniques.

Preferably certain events are excluded as false alarms if they do not meet the frequency and/or time characteristics determined for the event types.

According to another aspect of the invention there is provided a method of detecting intrusion events including at least two different event types which have different characteristics of frequency and time, the method comprising:

providing a sensor responsive to changes in a medium generated by a potential intrusion event with the sensor generating an output signal indicative of the changes in the medium;

analyzing the signal to determine changes in amplitude so as to detect the change in amplitude of the detection signal as a function of time;

wherein the algorithm requires the presence or absence of a time domain step function.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

With reference to the accompanying figures, the present invention relates to detection and false alarm suppression algorithms for the signals obtained by the above techniques or signals from other sensors.

The current method for detection lies significantly in a simple monitoring of the sensor and detect threshold crossings of amplitude. This, however, offers no discrimination between different event types such as cut, climb, and wind events.

This invention is multi layered, as follows:

Layer 1 consists of two algorithms—a time domain discrimination algorithm and a frequency domain algorithm.

Figure 1:
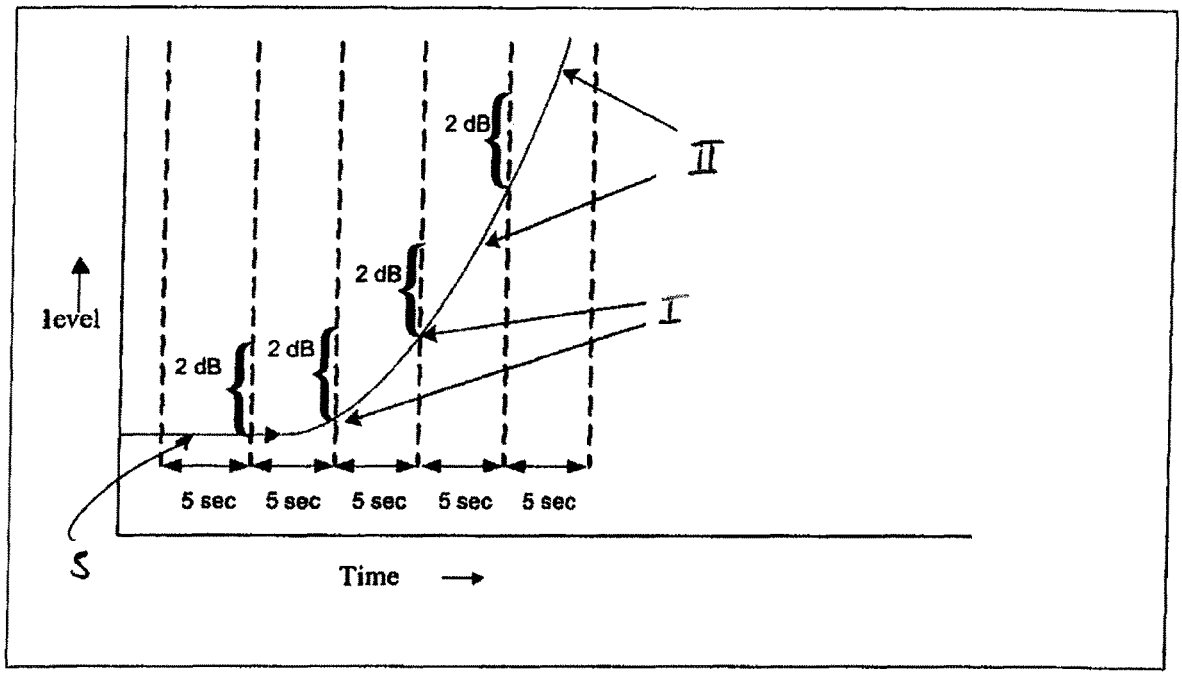
FIG. 1 is a graph of amplitude v time for the signal over a number of time bands.
Figure 2:
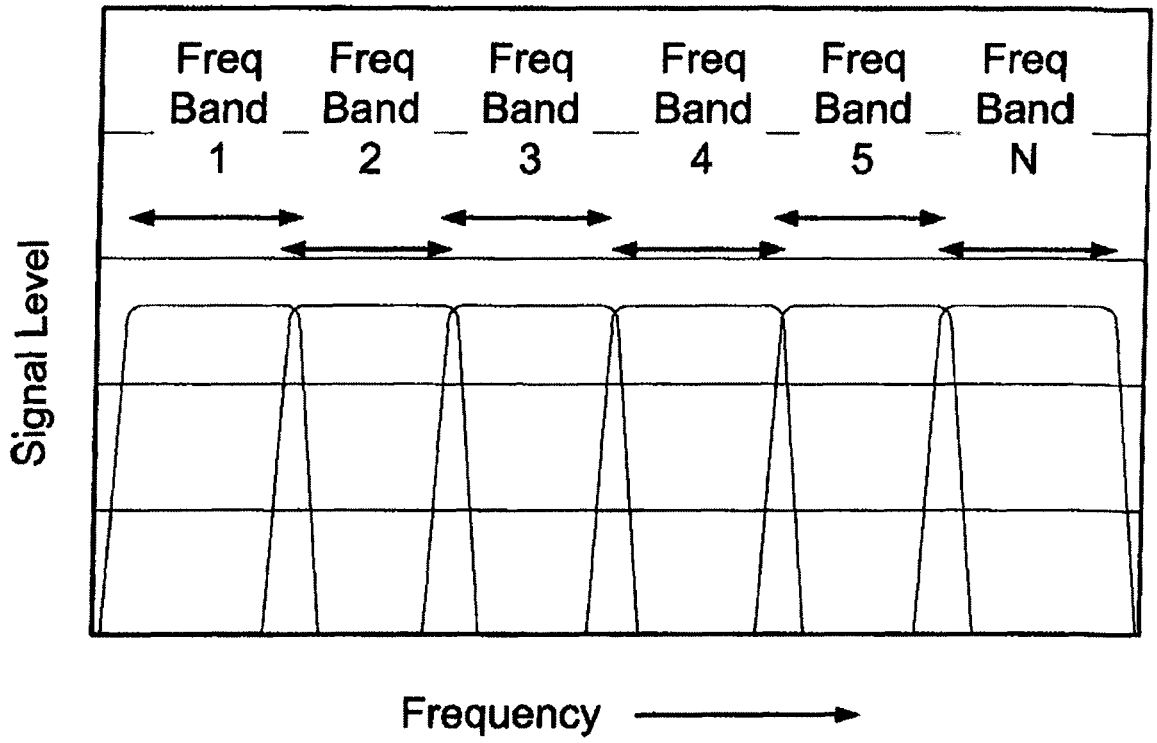
FIG. 2 is a graph of amplitude v frequency for the bands.

The time domain, at its root level, detects the change in amplitude of the detection signal as a function of time. That is, it monitors absolute change over a time slice, as illustrated in FIG. 1. FIG. 1 shows a level in decibels (dB) of the detection or output signal S over time. One key feature of this analysis is that the signal in respect to time should display a step function as shown in the Figures where the signal moves from level A to level B in a set period of time. For example, in order to be considered a step function, the level of the signal should increase by a prescribed threshold of 2 dB over a prescribed time interval of five seconds, that is when comparing the level at the beginning of the period as indicated at I and at the end thereof as indicated at II. Generally the algorithm will check whether the signal level has exceeded the threshold within the prescribed time interval. This allows the distinction to be made between the event types and the false alarms as the event type to be determined is required to meet this step function. If it does not it is either an event of type B or is neither and must therefore be a false alarm.

The frequency domain algorithm does a frequency analysis of the signal from the sensor, such as a Fast Fourier Transform. This frequency envelope is partitioned into multiple sections that correspond to the primary frequencies for each event type.

That is, prior analysis of each event type to be detected is carried out to determine time and frequency characteristics of the event.

For example, crossover points at 50 Hz and 500 Hz, as shown:

This invention utilizes a combination of events in a multi-dimensional matrix that analyzes one or more of: relative amplitude of each frequency, the duration of each detected event, the repetition rate of said event, the period over which this event occurs, and the presence or absence of a time domain step function.

As tabulated below:

| | Relative Amplitude per Freq Band Scale 1-10 | | | | | Event | Repetition | Repetition | Presence of Time |
|---|---|---|---|---|---|---|---|---|---|
| | F1 | F2 | F3 | F4 | FN | Duration | Rate | Period | Domain |
| Wind | 1-10 | 1-10 | 1-10 | 1-10 | 1-10 | A Sec | B Hz | C Hz | scale 1-10 |
| Climb | 1-10 | 1-10 | 1-10 | 1-10 | 1-10 | L Sec | M Hz | N Hz | scale 1-10 |
| Cut | 1-10 | 1-10 | 1-10 | 1-10 | 1-10 | X Sec | Y Hz | Z Hz | scale 1-10 |

For example, a person climbing a fence might step every 1.5 second, with an event lasting 500 mS, over the course of several seconds, with a heavy emphasis on the mid frequencies and presence of a time domain step function.

In another example, a person cutting the fence might show a clip every 500 mS, with an event lasting 100mS, over the course of tens of seconds, with a heavy emphasis in high frequencies and an absence of a step function.

This interaction of the data allows the system to:

1) Send out alerts that an unknown episode is occurring on the fence as soon as a signal is received indicative of a potential event.

2) After the appropriate time, the algorithm indicates the type of alert concerned such as cut or climb. This is carried out by the analysis herein wherein signal is analyzed for the frequency and time characteristics of the event type.

3) The same analysis allows the analysis to exclude certain events as false alarms if they do not meet the frequency and/or time characteristics determined for the event types.

This methodology can be expanded to accommodate other alarms or variables:

The characteristics of the event types can include many or few frequency bands of potentially varying widths.

The time characteristics of each event type can include more granularity in the time domain that monitors attributes such as repetition rate and period, including a multiple step envelope function showing rise, sustain, and fall times and rates.

The arrangement herein is not limited to sensors which generate signals by optical fibers or other conducts and can use other types of sensors which generate a detectable signal in response to other detectable events such as door opening, manhole cover lift, digging a hole.

Figure 3:
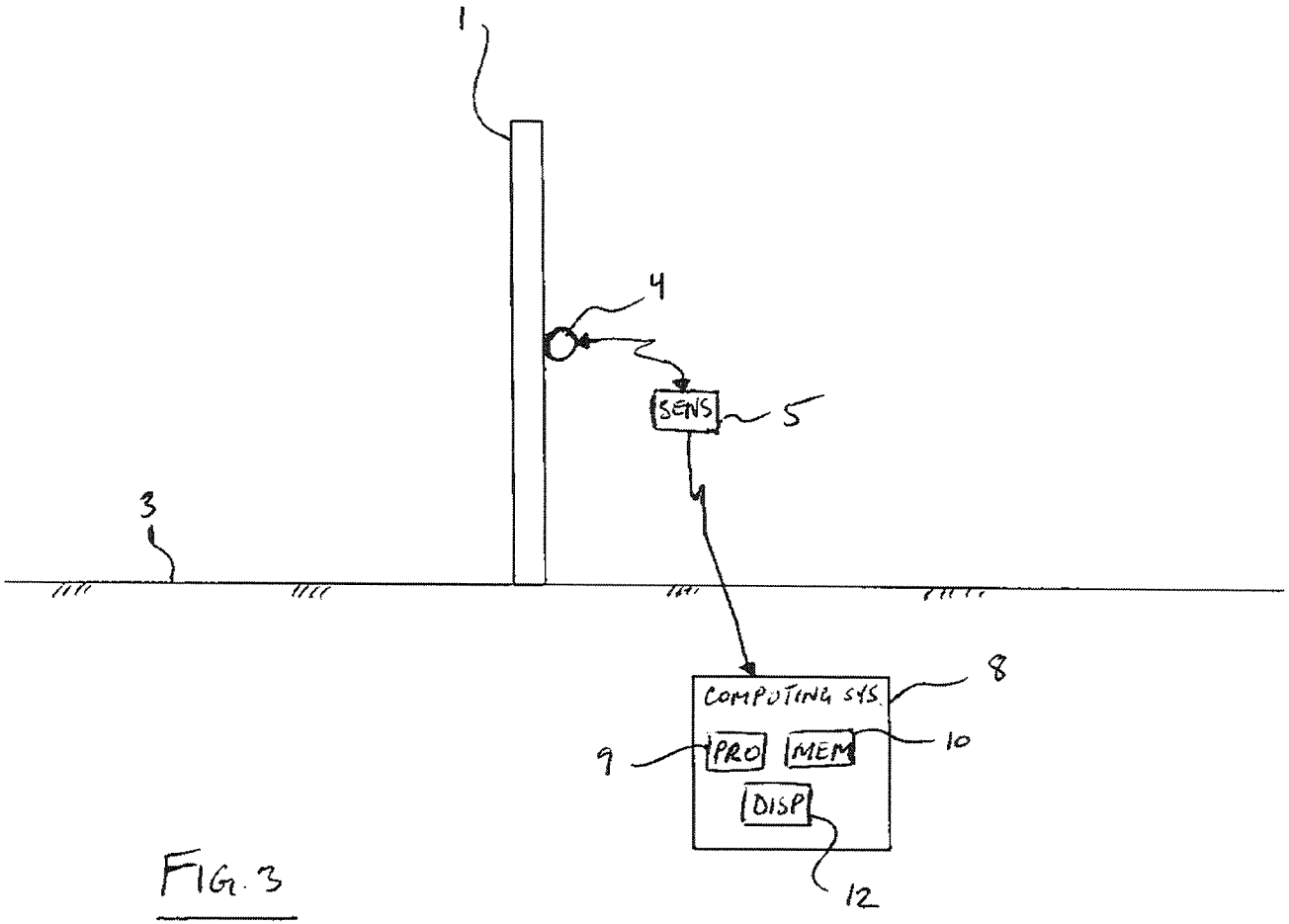
FIG. 3 is a schematic diagram of an arrangement of medium and sensor in which the method of the present invention may be applied.

FIG. 3 schematically illustrates an example of system which can perform the method of detecting intrusion events described hereinbefore. In this example the containment barrier being monitored is a fence 1 standing upwardly from ground surface 3. A detection medium 4 for example light carried by a fibre optic cable is operatively coupled to the barrier so that so that changes in a condition of the barrier marked by a potential intrusion event, for example vibration thereof which differs from an anticipated normal stationary condition of the barrier, acts to effect changes in the detection medium 4. A sensor 5 is operatively connected to the detection medium 4 to respond to those changes to generate an output signal indicative of the changes in the medium 4. The sensor 5 also is operatively connected to a computing system 8 such that the computing system can receive the output signal for analysis. The computing system 8 generally comprises a processor 9 and a memory 10 which are operatively interconnected. The computing system 8 conducts the analysis which includes an analysis in each of the time and frequency domains. The time domain analysis is used to determine whether the output signal includes a step function which normally is indicative of a potential intrusion event. If there is no such step function in the signal then this likely corresponds to a false alarm. The frequency analysis is used to identify further characteristics of the potential intrusion event. After the time and frequency domain analyses are completed the time and frequency characteristics are compared to a predetermined matrix or data table of the same types of time and frequency characteristics of a plurality of possible intrusion events. By comparison to these values in the matrix/table it can be determined what the potential intrusion event is, or whether it is a false alarm if the characteristics derived from the analysis of the potential intrusion event do not suitably match any set of values in the matrix. The computing system 8 is further arranged for indicating to a user what type of intrusion event has been detected, including whether this is a false alarm, for example by display 12.

The scope of the claims should not be limited by the preferred embodiments set forth in the examples but should be given the broadest so interpretation consistent with the specification as a whole.

The invention claimed is:

1. method of detecting intrusion events comprising:

wherein the intrusion events include at least two different event types which have different frequency characteristics and different time characteristics;

providing a sensor responsive to changes in a medium generated by said intrusion events with the sensor generating an output signal indicative of the changes in the medium;

analyzing the output signal in the time domain to determine changes in amplitude of the output signal so as to detect the change in amplitude of the output signal as a function of time;

in the frequency domain carrying out a frequency analysis of the output signals from the sensor;

and dividing the frequency analysis into separate frequency sections which where the frequency sections are selected so as to correspond to the characteristic frequencies for each event type.

2. he method according to claim 1 wherein the frequency analysis provides a combination of events in a multi-dimensional matrix that analyzes at least one of relative amplitude of each frequency section, the duration of each detected intrusion event, the repetition rate of said detected intrusion events, the period over which said detected intrusion events occur, and the presence or absence of a time domain step function.

3. he method according to claim 1 wherein the characteristic frequencies are selected so as to allow detection and suppression of false alarms.

4. he method according to claim 3 wherein detected intrusion events are excluded as false alarms if they do not meet the frequency characteristics and/or the time characteristics for the event types.

* * * * *